US010934840B1

(12) United States Patent
Geyer et al.

(10) Patent No.: US 10,934,840 B1
(45) Date of Patent: Mar. 2, 2021

(54) SELF-ALIGNING ADAPTER BLOCK

(71) Applicant: Kennametal Inc., Latrobe, PA (US)

(72) Inventors: James R. Geyer, Bedford, PA (US); Eric P. Helsel, Bedford, PA (US); Daniel J. Mouthaan, Park City, UT (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 16/552,224

(22) Filed: Aug. 27, 2019

(51) Int. Cl.
*E21C 35/19* (2006.01)
*E21C 35/197* (2006.01)

(52) U.S. Cl.
CPC ..... *E21C 35/191* (2020.05); *E21C 35/197* (2013.01)

(58) Field of Classification Search
CPC ..... E21C 35/19; E21C 35/191
See application file for complete search history.

(56) References Cited

U.S. PATENT DOCUMENTS 4,650,256 A * 3/1987 Wetzinger ..... E21C 35/19 299/107
4,944,560 A 7/1990 Osterwise
6,764,140 B2 7/2004 Carson et al.
7,380,888 B2 6/2008 Ojanen
8,061,783 B2 11/2011 Keller et al.
8,523,289 B2 9/2013 Helsel et al.
8,960,810 B2 2/2015 Fader
9,151,157 B2 10/2015 Glehnert et al.
9,212,554 B2 12/2015 Roetsch et al.
9,228,434 B2 1/2016 Lehnert et al.
9,260,965 B2 2/2016 Lehnert et al.
9,267,373 B2 2/2016 Kammerer et al.
9,376,911 B2 6/2016 Lehnert et al.
9,382,795 B2 * 7/2016 Bookhamer ..... E21C 35/19
D778,702 S 2/2017 Mouthaan
9,719,348 B2 8/2017 Lehnert et al.
9,797,246 B2 10/2017 Lehnert et al.
2011/0148178 A1 * 6/2011 Lehnert ..... E21C 35/193 299/105
2016/0194956 A1 7/2016 Sollami
2017/0198579 A1 * 7/2017 Magee ..... E21C 35/19
2017/0254200 A1 9/2017 Sollami

FOREIGN PATENT DOCUMENTS

DE 3909425 C1 * 8/1990 ..... E21C 35/191
DE 19908656 C1 * 8/2000 ..... E21C 35/193
DE 102011051520 1/2013
DE 202014010440 12/2015
GB 2077810 A * 12/1981 ..... E21C 35/191
WO WO-2006119536 A1 * 11/2006 ..... E21C 35/19

* cited by examiner

*Primary Examiner* — Janine M Kreck
(74) *Attorney, Agent, or Firm* — Larry R. Meenan

(57) ABSTRACT

Mounting assemblies for cutting tools are disclosed that include a base and an adapter block. Mounting assemblies are provided with self-fixturing features to provide a desired mounting position and to restrict movement of the adapter block with respect to the base prior to bonding. The self-fixturing features provide the ability to perform repeatable and consistent bonding of the adapter block to the base.

23 Claims, 14 Drawing Sheets

SELF-ALIGNING ADAPTER BLOCK

FIELD OF THE INVENTION

The present invention relates to a mounting assembly, and more particularly relates to mounting assemblies with features to ensure a proper and consistent mounting of an adapter block on a base block.

BACKGROUND INFORMATION

Earth working tools are used in conjunction with a machine used to break up (or cut) a substrate such as coal, rock, asphalt pavement, asphaltic concrete, concrete or the like.

In a conventional arrangement, such a machine includes a driven member (e.g., a chain, a wheel or a drum) and a cutting assembly comprising a base block either directly or indirectly mounted to the driven member, a tool holder mounted on the base block and a cutting tool held in the tool holder. It is the cutting tool that impinges the earth strata to break it into pieces and chunks upon impact. Because of the high wear environment, the cutting tool may have the shortest life of the mounting assembly and may be replaced before the base block and/or the tool holder.

The tool holder may be clamped on the base block by a mechanical fastener or may be bonded to the base block by welding, brazing or the like to form a mounting assembly. The presence of the tool holder helps protect the base block from abuse and wear, thus minimizing or eliminating the periods of down time otherwise required for drum repair. However, the tool holder is often misaligned on the base block prior to clamping or bonding. The misalignment may prevent secure engagement between the base block and the tool holder.

Cutting bits and cutting bit tool holders are subjected to considerable stresses during mining operations, road milling operations or other like operations. Accordingly, there is a desire to mount the cutting bit holder in the support block to minimize movement of the cutting bit holder to maximize the useful life of the cutting bit. The failure to provide secure engagement between the base block and the tool holder may reduce the life of the mounting assembly. It is also important that the mounting between the cutting bit tool holder and the base block be resistant to vibratory loosening which could likewise lead to premature cutting bit wear and failure.

SUMMARY OF THE INVENTION

Mounting assemblies for cutting tools are provided that include a base block and an adapter block with mounting features to enable proper and consistent alignment and bonding. The mounting assembly is structured and arranged for attachment to a surface of a rotatable driving member of a cutting tool machine. The adapter block is structured and arranged to removably receive a tool holder and a cutting tool. The base block and the adapter block each comprise self-fixturing features to provide a desired mounting position for the adapter block on the base block. The self-fixturing features restrict movement and position the corresponding surfaces of the adapter block and base block at selected positions to allow for proper and consistent bonding to form the mounting assembly.

An aspect of the present invention is to provide a mounting assembly for a cutting tool comprising a base comprising a holder receiving surface including a planar intersection recessed in the holder receiver surface, and an adapter block, the adapter block comprising an adapter block body having a top surface and a mounting surface, at least one alignment protrusion extending from the mounting surface and structured and arranged to be received within the planar intersection of the base.

Another aspect of the present invention is to provide an adapter block for a cutting tool mounting assembly comprising an adapter block body having a top surface and a mounting surface, at least one alignment protrusion extending from the mounting surface and structured and arranged to be received within a first planar intersection of a base block, and at least one alignment tab extending from the mounting surface and structured and arranged to be received within a first planar intersection of a base block.

These and other aspects of the present invention will be more apparent from the following description.

DETAILED DESCRIPTION

Mounting assemblies for cutting tools are provided with self-fixturing features to provide a desired mounting position and to restrict movement of an adapter block with respect to a base block prior to bonding. The mounting assemblies may be used to secure varying cutting tools such as cutting bits, sleeves for cutting bits, holders for cutting bits, working tools, sleeves for working tools, holders for working tools and the like. The self-fixturing features of the mounting assemblies provide the ability to perform repeatable and consistent alignment and bonding of the adapter block on the base block. It is desirable to minimize movement of the adapter block on the base block to protect and maximize the useful life of the base block mounted on a rotatable drum. In accordance with an embodiment of the present invention, the self-fixturing features allow for a repeatable and consistent alignment of the adapter block on the base block to form the mounting assembly. In accordance with an embodiment of the present invention, the mounting assemblies may be formed before or after the base block is attached to a rotatable driving member of a cutting tool machine.

Figure 8:
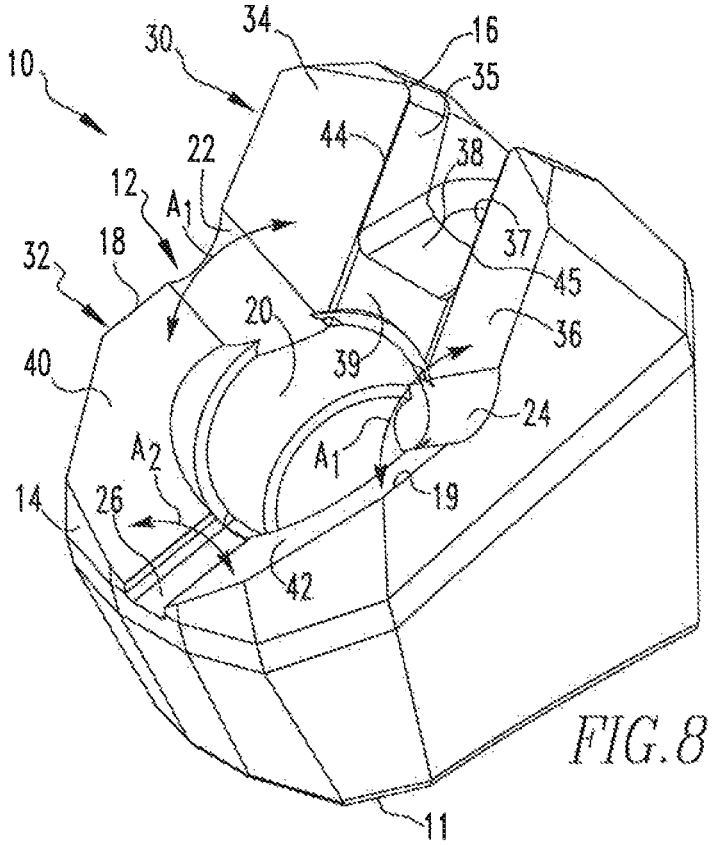
FIG. 8 is an isometric view of a base block in accordance with an embodiment of the present invention.
Figure 9:
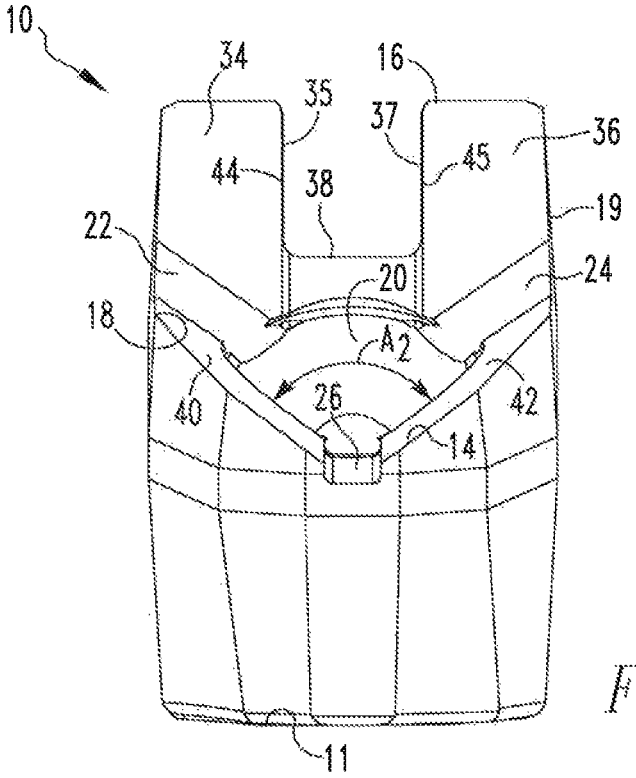
FIG. 9 is a front view of the base block of FIG. 8.
Figure 10:
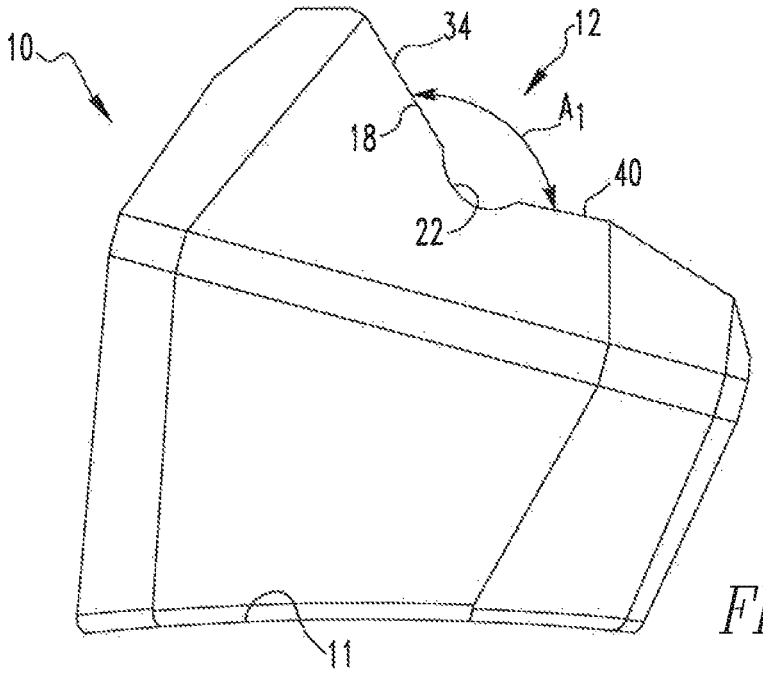
FIG. 10 is a side view of the base block of FIG. 8.
Figure 11:
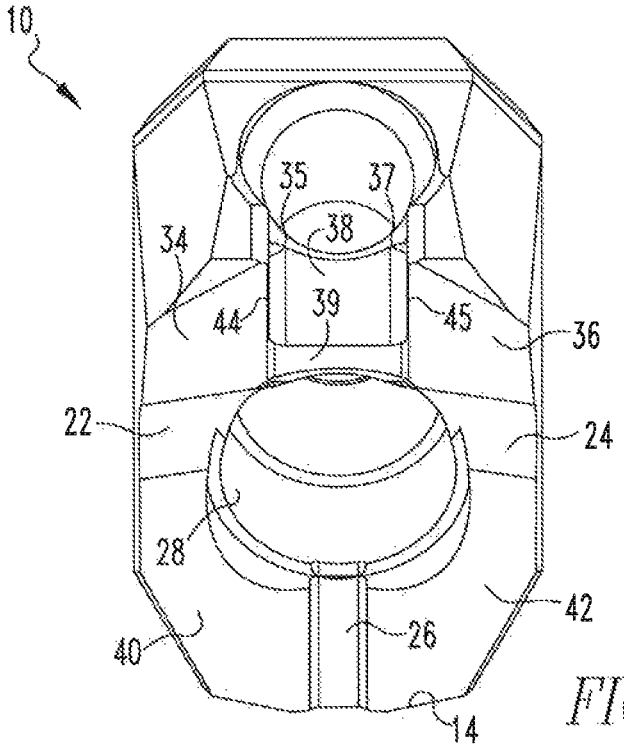
FIG. 11 is a top view of the base block of FIG. 8.

FIGS. 1-7 illustrate a mounting assembly 5 in accordance with an embodiment of the present invention. The mounting assembly 5 includes a base 10 and an adapter block 50. As shown in FIG. 8, the base 10 has a bottom surface 11 structured and arranged to be mounted to a rotatable driving member (not shown) and a holder receiving surface 12 having a front edge 14, a rear edge 16, first and second sides 18 and 19, and a clearance opening 20. In accordance with an embodiment of the present invention, the holder receiving surface 12 of the base 10 comprises a first planar intersection 22 extending from the first side edge 18 of the holder receiving surface 12 to the clearance opening 20, a second planar intersection 24 extending from the clearance opening 20 to the second side edge 19 of the holder receiving surface 12, and a front planar intersection 26 extending from the front edge 14 of the holder receiving surface 12 to the clearance opening 20, as shown in FIGS. 8, 9 and 11. As used herein the term "planar intersection" means a region between adjacent planar surfaces that are angled with respect to each other, i.e., the adjacent planar surfaces do not lie in the same plane as each other or in a parallel plane with each other. In the embodiment shown in FIGS. 1-11, the first and second planar intersections 22 and 24 and the front planar intersection 26 are formed by grooves, however, any other suitable arrangement may be used. As shown in FIGS. 8, 9 and 11, the holder receiving surface 12 of the base 10 includes a first mounting region 30 extending from the rear edge 16 to the first and second planar intersections 22 and 24, and a second mounting region 32 extending from the first and second planar intersections 22 and 24 to the front edge 14 of the holder receiving surface 12.

In accordance with an embodiment of the present invention, the first mounting region 30 of the holder receiving surface 12 comprises a first rear planar face 34 and a second rear planar face 36. In the embodiment shown, the first rear planar face 34 is separated from the second rear planar face 36 by an opening 38. The first rear planar face 34 extends from the first side edge 18 to the opening 38 and the second rear planar face 36 extends from the opening 38 to the second side edge 19. As shown in FIGS. 8 and 9, the opening 38 may be formed by opposing faces 35 and 37. In certain embodiments, the first opposing face 35 extends from the first rear planar face 34 and the second opposing face 37 extends from the second rear planar face 36. In accordance with an embodiment of the present invention, a first intersection 44 may be formed between the first opposing face 35 and the first rear planar face 34 and a second intersection 45 may be formed between the second opposing face 37 and the second rear planar face 36. In the embodiment shown, the first intersection 44 is formed as a corner between the first rear planar face 34 and the first opposing face 35 and the second intersection 45 is formed as a corner between the second rear planar face 36 and the second opposing face 37. However, any other suitable arrangement may be used, e.g., the first and second intersections 44 and 45 may each be formed as a planar face, bevel, taper or the like.

In accordance with an embodiment of the present invention, the holder receiving surface 12 comprises a central rear planar face 39 extending between the first and second rear planar faces 34 and 36. In the embodiment shown, the first rear planar face 34 is provided at an angle with respect to the second rear planar face 36. However, any other suitable arrangement may be used, e.g., the first and second rear planar faces 34 and 36 may be parallel. In accordance with an embodiment of the present invention, the second mounting region 32 of the holder receiving surface 12 comprises a first front planar face 40 and a second front planar face 42. In the embodiment shown, the first front planar face 40 is separated from the second front planar face 42 by the front planar intersection 26. The first front planar face 40 extends from the first side edge 18 to the front planar intersection 26 and the second front planar face 42 extends from the front planar intersection 26 to the second side edge 19. In the embodiment shown, the first front planar face 40 is provided at an angle with respect to the second front planar face 42. However, any other suitable arrangement may be used, e.g., the first and second front planar faces 40 and 42 may be parallel. In accordance with an embodiment of the present invention the first and second rear planar faces 34 and 36 of the first mounting region 30 may be provided at an angle with respect to the first and second front planar faces 40 and 42 of the second mounting region 32.

Figure 12:
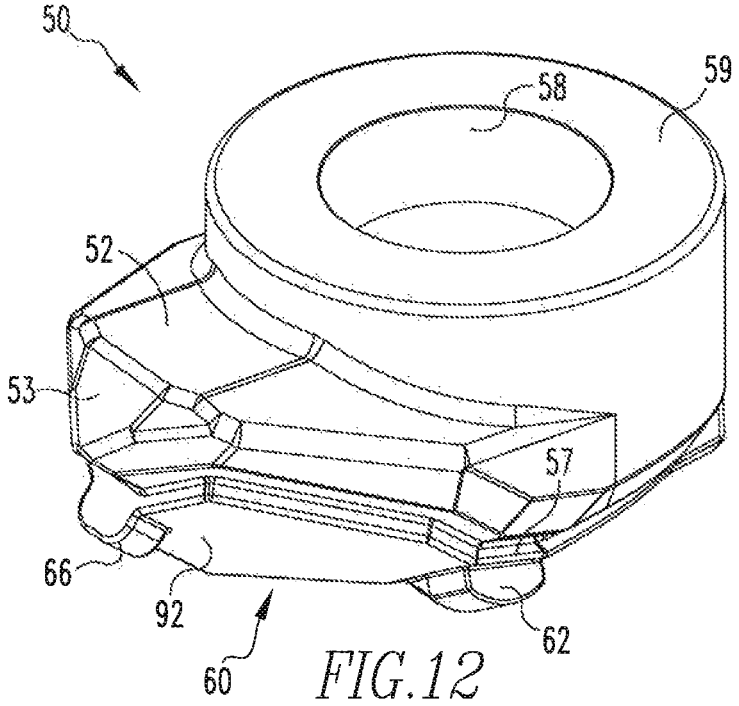
FIG. 12 is a top-front isometric view of an adapter block in accordance with an embodiment of the present invention.

As shown in FIG. 12, the adapter block 50 has a top surface 52, a front nose portion 53, a rear portion 54, first and second sides 56 and 57 and a mounting surface 60. In accordance with an embodiment of the present invention, the adapter block 50 comprises a bore 58 surrounded by a shoulder 59 protruding from the top surface 52 of the adapter block 50. In the embodiment shown, the bore 58 extends through the body of the adapter block 50 from the top of the shoulder 59 to the mounting surface 60. The bore 58 may be structured and arranged to allow a shank of a cutting tool, sleeve or tool holder (not shown) to be inserted into the adapter block 50. In accordance with an embodiment of the present invention, the shoulder 59 may be provided with any suitable dimensions to receive a variety of cutting tools, sleeves or tool holders such as PCD tools, carbide tools and the like. In certain embodiments, the bore 58 may be varied in size and shape depending on the size and configuration of the cutting tool. In accordance with an embodiment of the present invention, the cutting tool may be secured in the adapter block 50 by any suitable means. For example, a circumferential groove and retaining ring, radial projections or recesses on the adapter block 50 or cutting tool, press fits, snap fits, mechanical fasteners and the like may be used to retain the cutting tool in the bore 58 of the adapter block 50.

As shown in FIGS. 12-15, 17 and 18, the mounting surface 60 of the adapter block 50 includes an alignment protrusion 62 extending from the mounting surface 60 which may engage the holder receiving surface 12 of the base 10 and an alignment tab 66 extending from the mounting surface 60 which may engage the holder receiving surface 12 of the base 10. As used herein, the terms "engage", "engages", and "engagement" and "engaging" mean that two or more features interact with each other to restrict relative movement between the adapter block 50 and the base 10. In the embodiment shown, the alignment protrusion 62 is sized and located to engage the first and second planar intersections 22 and 24 of the base 10, and the alignment tab 66 is sized and located to engage the front planar intersection 26 of the base 10. For example, the alignment protrusion 62 and the alignment tab 66 are structured and arranged to be received within the first and second planar intersections 22 and 24 and the front planar intersection 26 formed as grooves.

Figure 14:
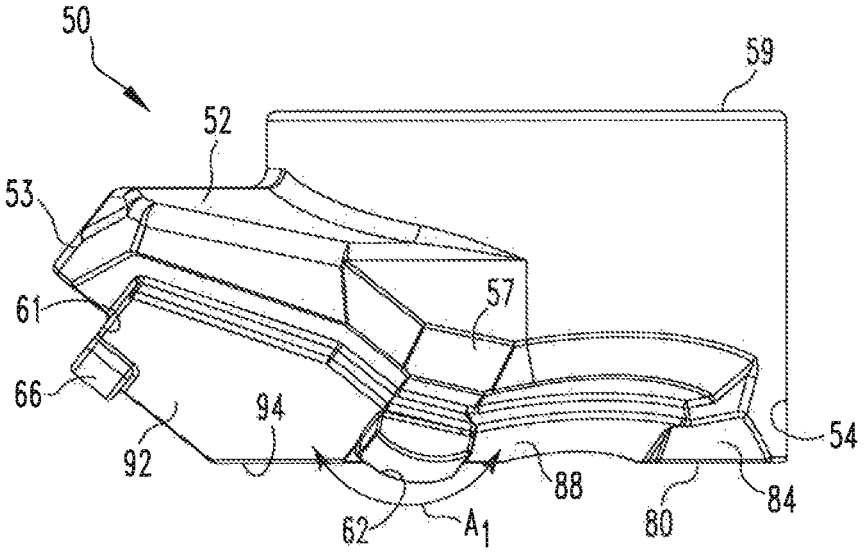
FIG. 14 is a side view of the adapter block of FIG. 12.
Figure 15:
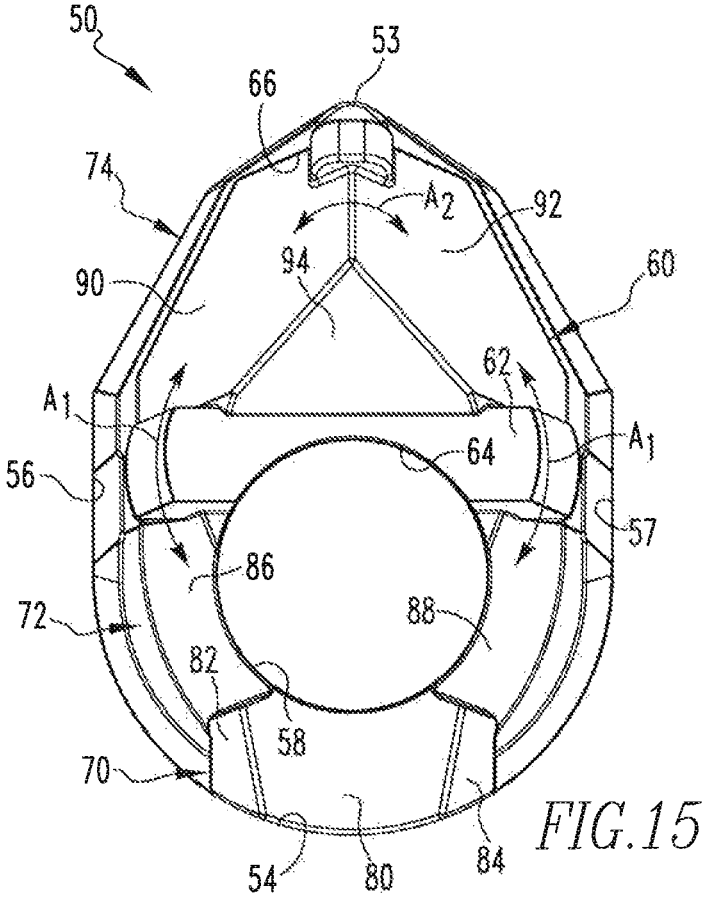
FIG. 15 is bottom view of the adapter block of FIG. 12.
Figure 16:
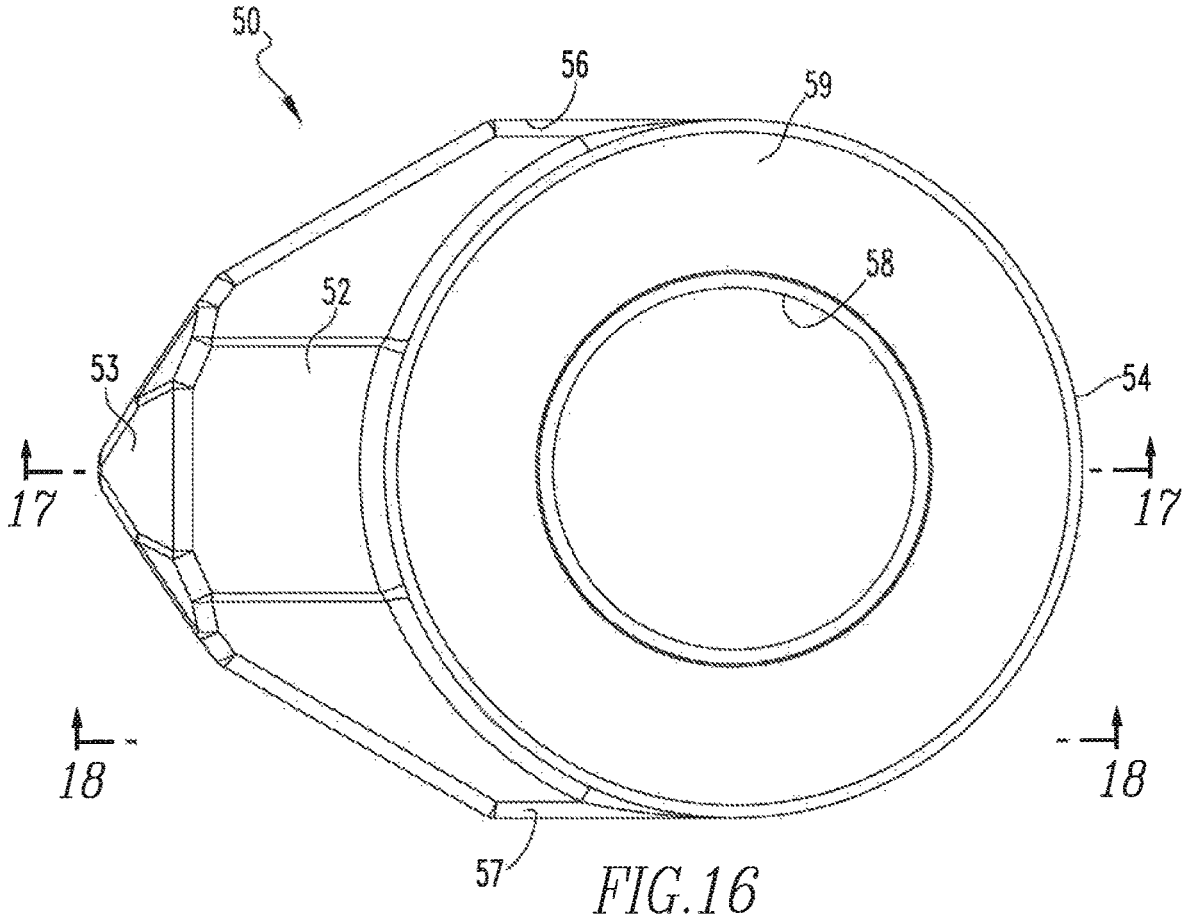
FIG. 16 is a top view of the adapter block of FIG. 12.
Figure 17:
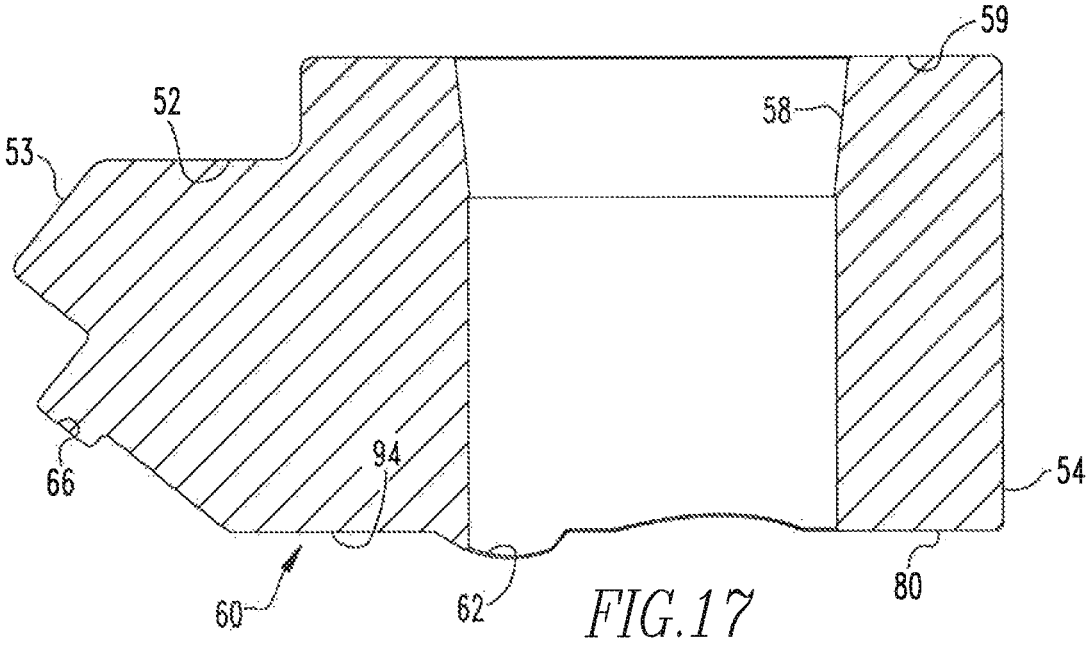
FIG. 17 is a side-sectional view of the mounting assembly taken through line 17-17 of FIG. 16.
Figure 18:
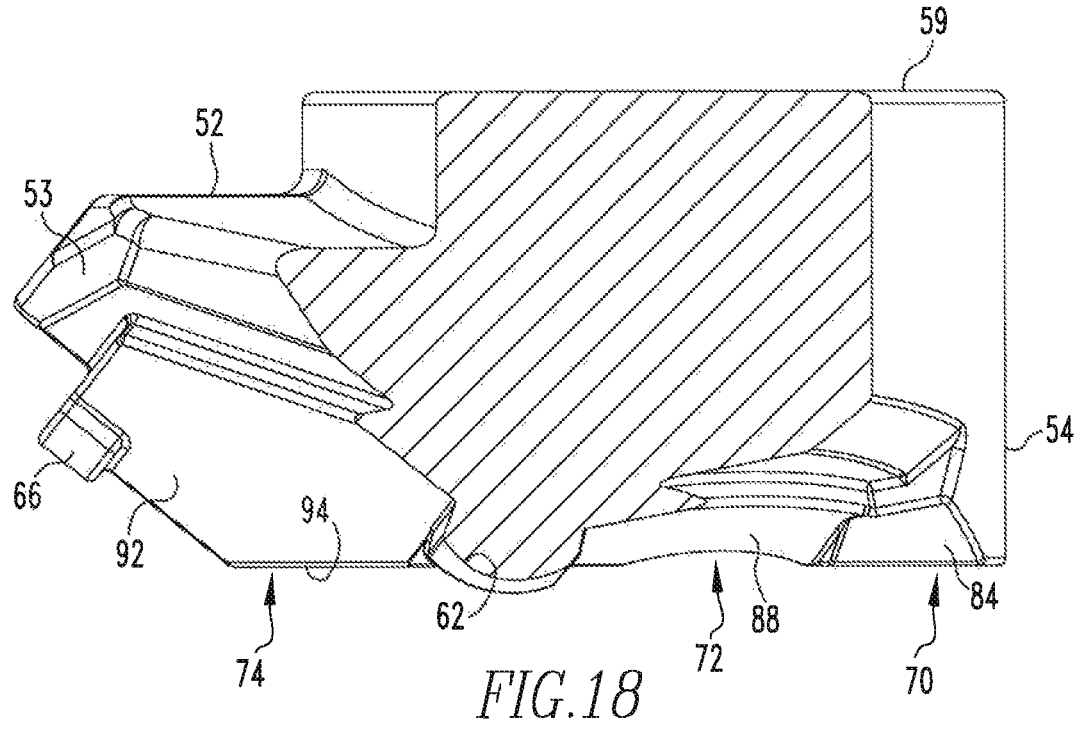
FIG. 18 is a side-sectional view of the mounting assembly taken through line 18-18 of FIG. 16.

As shown in FIGS. 14 and 15, the mounting surface 60 of the adapter block 50 includes a rear base engagement region 70 extending from the rear portion 54 to a first base engagement region 72. In the embodiment shown, the first base engagement region 72 extends from the rear base engagement region 70 to the alignment protrusion 62. The mounting surface 60 further comprises a front base engagement region 74 extending from the alignment protrusion 62 to a front edge 61 of the mounting surface 60. In accordance with an embodiment of the present invention, the rear base engagement region 70 includes a central portion 80 and first and second angled portions 82 and 84. In accordance with an embodiment of the present invention, the first base engagement region 72 of the mounting surface 60 comprises a first planar face 86 and a second rear planar face 88. In the embodiment shown, the first planar face 86 is separated from the second planar face 88 by the bore 58. In the embodiment shown, the first planar face 86 is provided at an angle with respect to the second planar face 88. However, any other suitable arrangement may be used, e.g., the first and second planar faces 86 and 88 may be parallel. In certain embodiments, the size and orientation of the first and second planar faces 86 and 88 may be varied to correspond to the holder receiving surface 12 of the base 10. In accordance with an embodiment of the present invention, the front base engagement region 74 of the mounting surface 60 comprises a first front planar face 90 and a second front planar face 92. In the embodiment shown, the front base engagement region 74 includes a central front planar face 94 between the first front planar face 90 and the second front planar face 92. In the embodiment shown, the first front planar face 90 is provided at an angle with respect to the second front planar face 92. However, any other suitable arrangement may be used, e.g., the first and second front planar faces 90 and 92 may be parallel. In certain embodiments, the size and orientation of the first and second front planar faces 90 and 92 may be varied to correspond to the holder receiving surface 12 of the base 10. In accordance with an embodiment of the present invention the first and second planar faces 86 and 88 of the first base engagement region 72 may be provided at an angle with respect to the first and second front planar faces 90 and 92 of the front base engagement region 74.

Figure 1:
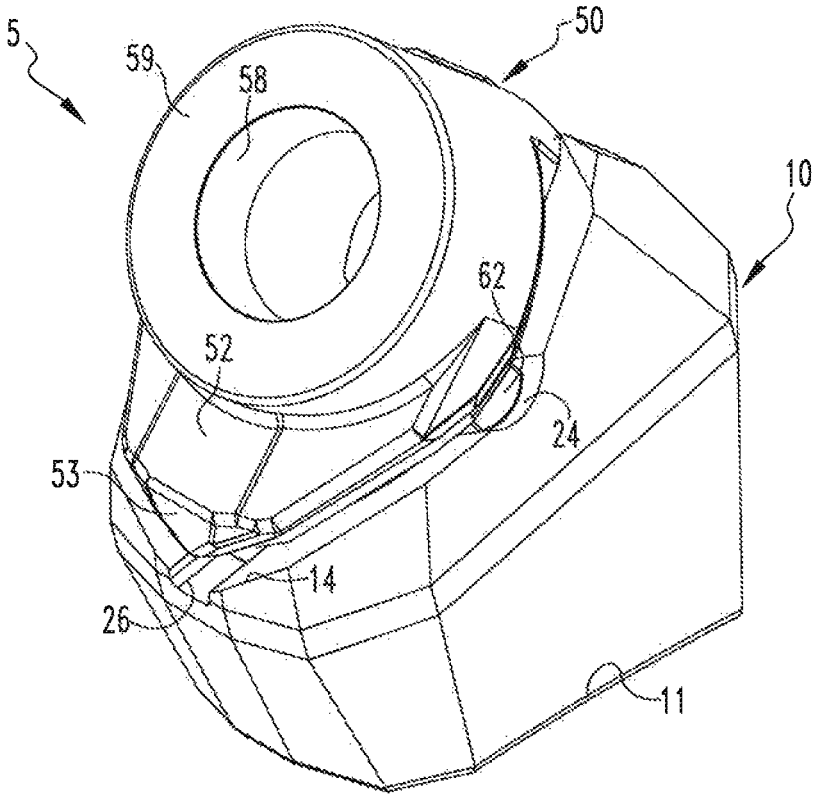
FIG. 1 is a top-front isometric view of a mounting assembly in accordance with an embodiment of the present invention.
Figure 2:
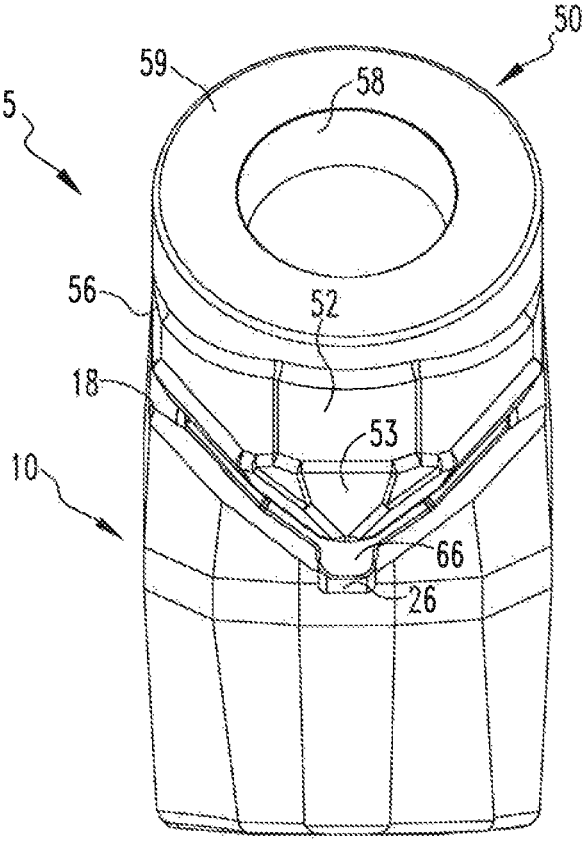
FIG. 2 is a front view of the mounting assembly of FIG. 1.
Figure 3:
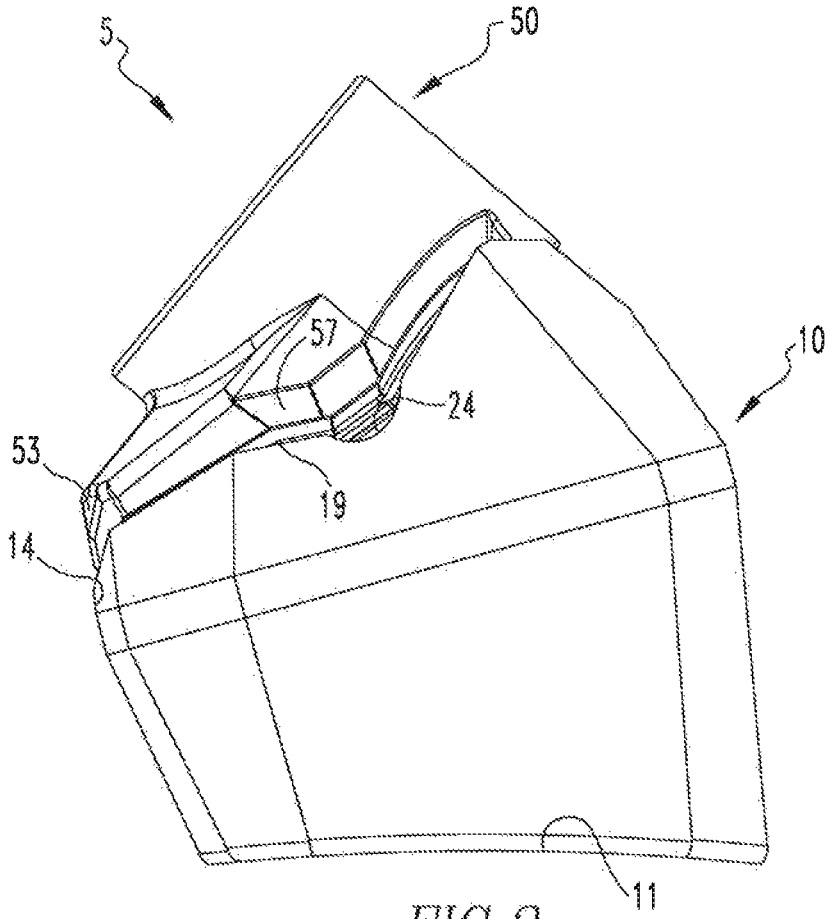
FIG. 3 is a side view of the mounting assembly of FIG. 1.
Figure 4:
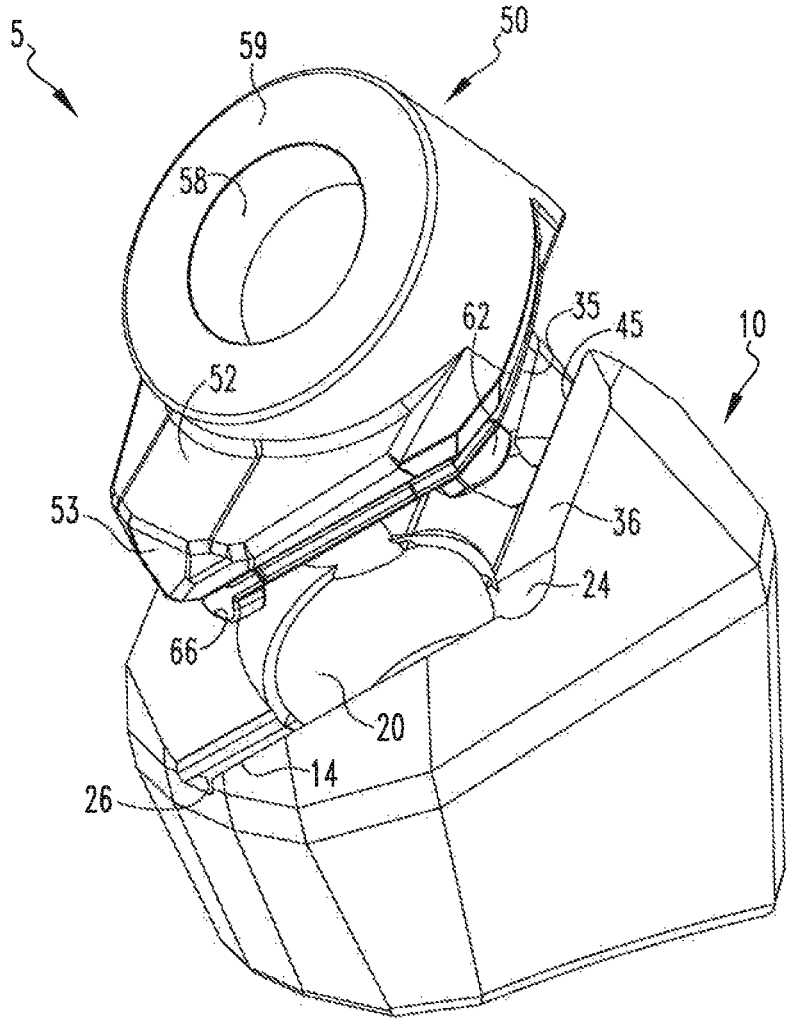
FIG. 4 is an exploded isometric view of the mounting assembly of FIG. 1.
Figure 5:
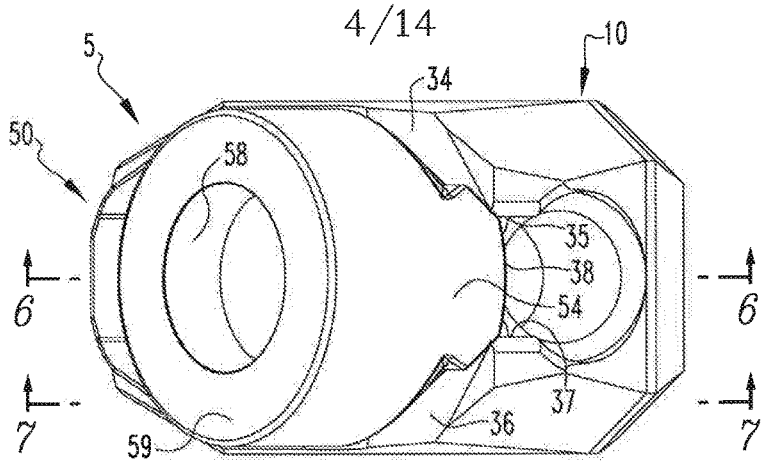
FIG. 5 is a top view of the mounting assembly of FIG. 1.
Figure 6:
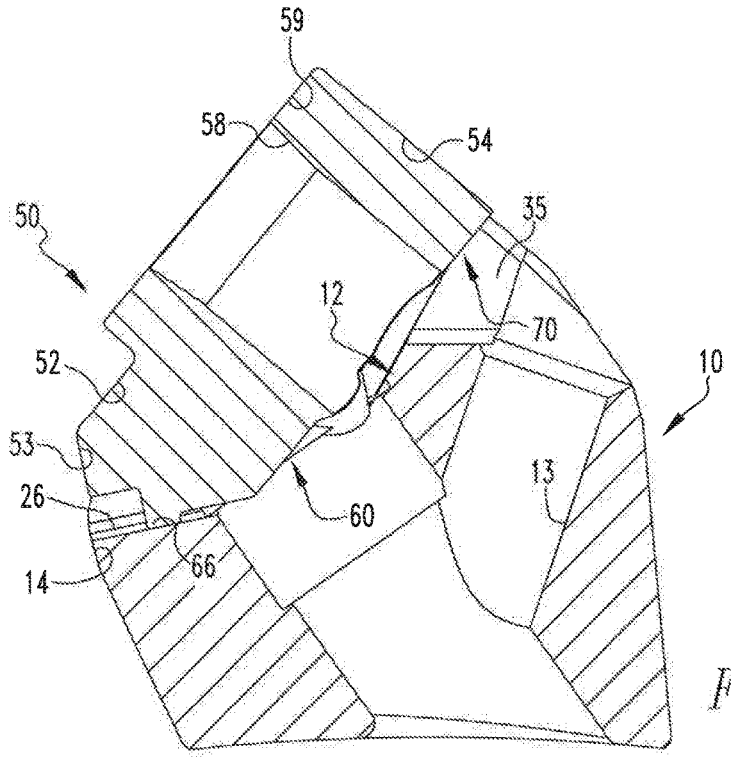
FIG. 6 is a side-sectional view of the mounting assembly taken through line 6-6 of FIG. 5.
Figure 7:
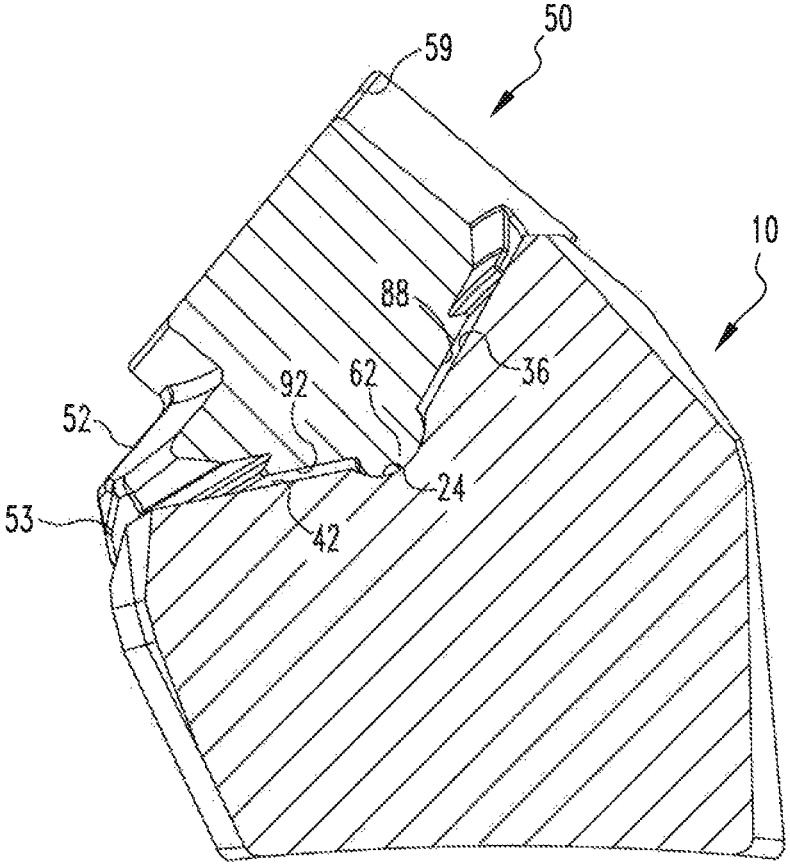
FIG. 7 is a side-sectional view of the mounting assembly taken through line 7-7 of FIG. 5.

As shown in FIGS. 1-7, the mounting surface 60 of the adapter block 50 is structured and arranged to mate with the holder receiving surface 12 of the base 10. In the embodiment shown, the adapter block 50 is structured and arranged to allow its first and second sides 56 and 57 to align with the first and second sides 18 and 19 of the base 10. Alternatively, the adapter block 50 may be sized to allow its first and second sides 56 and 57 to extend beyond the first and second sides 18 and 19 of the base 10. As shown in FIGS. 3, 5 and 7, the adapter block 50 may be also be structured and arranged to allow its front nose portion 53 to align with the front edge 14 of the base 10. Aligning the adapter block 50 with the base 10 may allow the base 10 to be protected from the abrasive effects of cutting operations.

As shown in FIGS. 1-7, the base 10 and the adapter block 50 have complementary features to selectively position and align the adapter block 50 on the base 10 for bonding without the need to measure or adjust the adapter block 50 on the base 10. In accordance with an embodiment of the present invention, the base 10 and the adapter block 50 each comprise features to repeatedly and consistently allow for the adapter block 50 to be fixedly secured onto the base 10. When the adapter block 50 is placed on the base 10, the complementary features of the mounting surface 60 and the holder receiving surface 12 align the two separate components. In accordance with an embodiment of the present invention, the adapter block 50 may be then bonded to the base 10 by welding. However, any other suitable method of bonding known to those skilled in the art, for example, brazing, adhesives, mechanical fasteners or the like may be used to fixedly secure the adapter block on the base.

In accordance with an embodiment of the present invention, when the adapter block 50 is placed onto the base 10, the alignment protrusion 62, the alignment tab 66 and the rear base engagement region 70 of the adapter block 50 may be the lone points of contact between the mounting surface 60 and the holder receiving surface 12 of the base 10 prior to bonding, as shown in FIGS. 6 and 7. For example, as further described below, the alignment protrusion 62 may contact the first and second planar intersections 22 and 24 of the holder receiving surface 12, the alignment tab 66 may contact the front planar intersection 26. In certain embodiments, the first and second angled portions 82 and 84 of the rear base engagement region 70 may contact the first and second intersections 44 and 45 and/or the first and second opposing faces 35 and 37 of the base 10. Contact between the alignment features may allow mounting of the adapter block 50 on the base 10 by aligning corresponding faces of the mounting surface 60 and the holder receiving surface 12 as more fully described below.

As shown in FIGS. 1-7, the rear base engagement region 70 of the adapter block 50 is structured and arranged to correspond with the opening 38 of the base 10. In accordance with an embodiment of the present invention, the first angled portion 82 of the rear base engagement portion 70 may mate or engage with the first opposing face 35 and/or the first intersection 44 of the base 10 and the second angled portion 84 of the rear base engagement portion 70 may mate or engage with the second opposing face 37 and/or the second intersection 45 of the base 10. In accordance with another embodiment of the present invention, the central portion 80 of the rear engagement portion 70 may mate or engage with the central rear planar face 39. In accordance with an embodiment of the present invention, engagement between the rear base engagement region 70 of the adapter block 50 and the first and second intersections 44 and 45 of the base may align the adapter block 50 on the base 10.

In accordance with an embodiment of the present invention, the first base engagement region 72 of the adapter block 50 is structured and arranged to correspond with the first mounting region 30 of the base 10 and the front base engagement region 74 of the adapter block 50 is structured and arranged to correspond with the second mounting region 32 of the base 10. In certain embodiments, when the adapter block 50 is placed on the base 10, the first planar face 86 of the first base engagement region 72 is aligned with the first rear planar face 34 of the first mounting region 30 of the base 10 and the second planar face 88 of the first base engagement region 72 is aligned with the second rear planar face 36 of the first mounting region 30 of the base 10. In certain embodiments, when the adapter block 50 is placed on the base 10, the first front planar face 90 of the front base engagement region 74 is aligned with the first front planar face 40 of the second mounting region 32 of the base 10 and the second front planar face 92 of the first front base engagement region 74 is aligned with the second front planar face 42 of the second mounting region 32 of the base 10. As previously discussed above, the size and orientation of the faces of the mounting surface 60 of the adapter block 50 may be varied depending on the size and orientation of the faces of the holder receiving surface 12 of the base 10.

Figure 13:
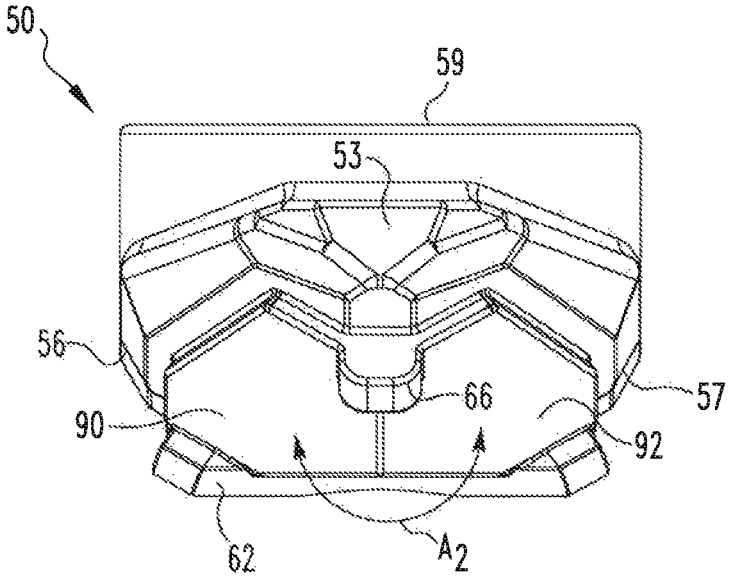
FIG. 13 is a front view of the adapter block of FIG. 12.

In certain embodiments, the orientation of the planar faces of the holder receiving surface 12 of the base 10 are selected in order to receive the adapter block 50. As shown in FIGS. 8 and 10, the angle $A_1$ between the first and second rear planar faces 34 and 36 and the first and second front planar faces 40 and 42 may typically range from 90 to 179 degrees, or from 120 to 170 degrees or from 130 to 160 degrees. As shown in FIGS. 9 and 10, the angle $A_2$ between the first and second front planar faces 40 and 42 may typically range from 60 to 179 degrees, or from 80 to 160 degrees or from 100 to 120 degrees. In certain embodiments, the orientation of the planar faces of the mounting surface 60 of the adapter block 50 may be selected to correspond to the angles of the holder receiving surface 12 of the base 10. In certain embodiments, the angle between the first and second planar faces 86 and 88 and the first and second front planar faces 90 and 92 of the adapter block 50 may be substantially equal to angle $A_1$, as shown in FIGS. 14 and 15. For example, the angle $A_1$ between the first and second planar faces 86 and 88 and the first and second front planar faces 90 and 92 of the adapter block 50 may typically range from 90 to 179 degrees, or from 120 to 170 degrees or from 130 to 160 degrees. In certain embodiments, the angle between the first and second front planar faces 90 and 92 may be substantially equal to angle $A_2$, as shown in FIGS. 13 and 15. For example, the angle $A_2$ between the first and second front planar faces 90 and 92 may typically range from 60 to 179 degrees, or from 80 to 160 degrees or from 100 to 120 degrees. In accordance with an embodiment of the present invention, the angles $A_1$ and $A_2$ between the planar faces of the adapter block 50 may be modified to correspond to the angles $A_1$ and $A_2$ between the planar faces of the base 10.

As shown in FIGS. 6 and 7, when the adapter block 50 is placed on the base 10, the first planar face 86, the second planar face 88, the first front planar face 90 and the second front planar face 92 of the adapter block 50 and the first rear planar face 34, the second rear planar face 36, the first front planar face 40 and the second front planar face 42 of the base 10 may be aligned in parallel planes that are offset from each other. The offset between the planar faces of the mounting surface 60 of the adapter block 50 and the holder receiving surface 12 of the base 10 may provide an air gap for bonding and a clearance to ensure proper alignment between the adapter block 50 and the base 10. For example, the second front planar face 92 of the adapter block 50 may be spaced from the second front planar face 42 of the base 10 by at least 0.01 inch, or at least 0.025 inch, or at least 0.05 inch, or at least 0.06 inch. In accordance with an embodiment of the present invention, the offset spacing between the adapter block 50 and the base 10 may be closed when the adapter block 50 is bonded to the base 10. For example, the spacing between the planar faces of the adapter block 50 and the base 10 may be closed by welding, filled with braze material, adhesives or the like. Alternatively, when the adapter block 50 is placed on the base 10, the first planar face 86, the second planar face 88, the first front planar face 90 and the second front planar face 92 of the adapter block 50 and the first rear planar face 34, the second rear planar face 36, the first front planar face 40 and the second front planar face 42 of the base 10 may contact or mate with the corresponding face.

In accordance with an embodiment of the present invention, the first and second planar intersections 22 and 24 of the base 10 may engage the alignment protrusion 62 of the adapter block 50 to restrict movement of the adapter block 50 in relation to the base 10. The alignment protrusion 62 has an extension distance from the mounting surface 60 selected to engage with the first and second planar intersections 22 and 24. For example, the extension distance of the alignment protrusion 62 may typically range from 0 to 0.5 inch, or from 0.1 to 0.4 inch, or from 0.15 to 0.25 inch. In certain embodiments, the first and second planar intersections 22 and 24 may be formed as grooves recessed in the holder receiving surface 12 having a depth, as shown in FIGS. 4, 7, 8 and 9. For example, the depth of the first and second planar intersections 22 and 24 may typically range from 0 to 0.4 inch, or from 0.1 to 0.3 inch, or from 0.15 to 0.2 inch. Alternatively, the first and second planar intersections 22 and 24 may be formed as intersections of two or more planar surfaces of the base 10. The extension distance of the alignment protrusion 62 is typically slightly larger than any depth of the first and second planar intersections 22 and 24 in order to provide a desired spacing between the mounting surface 60 and the holder receiving surface 12. For example, the alignment protrusion 62 may be from 0.01 to 0.2 inch larger than the depth of the first and second planar intersections 22 and 24, or from 0.02 to 0.1 inch larger, as shown in FIG. 7. In accordance with an embodiment of the present invention, the alignment protrusion 62 has an extension distance less than a distance between the top surface 52 and the mounting surface 60 of the adapter block 50.

As shown in FIGS. 13 and 15, the alignment protrusion 62 may be a single protrusion extending from the first side 56 to a second side 57 of the mounting surface 60 of the adapter block 50. However, any other suitable arrangement and number of alignment protrusion(s) 62 may be used, e.g., the mounting surface 60 may have two or more alignment protrusions 62 corresponding to the first and second planar intersections 22 and 24 of the base 10. As shown in FIG. 15, the alignment protrusion 62 may include a notch 64 formed by the bore 58 of the adapter block 50. As shown in FIGS. 6 and 7, the notch 64 may allow the alignment protrusion 62 to extend across the mounting surface 60 of the adapter block 50 at the desired location corresponding to the first and second planar intersections 22 and 24 of the base 10.

In accordance with an embodiment of the present invention, the alignment protrusion 62 has a width selected to engage with the first and second planar intersections 22 and 24. For example, the width of the alignment protrusion 62 may typically range from 0 to 0.75 inch, or from 0.2 to 0.6 inch, or from 0.4 to 0.55 inch. As shown in FIGS. 4, 7, 8 and 9, the first and second planar intersections 22 and 24 formed as grooves may have a width. For example, the width of the first and second planar intersections 22 and 24 may range from 0 to 0.85 inch, or from 0.3 to 0.7 inch, or from 0.5 to 0.65 inch. The width of the alignment protrusion 62 may be selected to allow a clearance fit between the alignment protrusion 62 and the first and second planar intersections 22 and 24. However, any other suitable type of fit between the alignment protrusion 62 and the first and second planar intersections 22 and 24 may be used, such as, a slip fit, a slide fit, a press fit, or the like. In accordance with another embodiment of the present invention, the alignment protrusion 62 may only make line or band contact with the holder receiving surface 12 at or near the first and second planar intersections 22 and 24.

In certain embodiments, engagement between the alignment protrusion 62 and the first and second planar intersections 22 and 24 may provide the desired alignment of the adapter block 50 on the base 10. For example, the engagement between the alignment protrusion 62 and the first and second planar intersections 22 and 24 may prevent forward and rearward movement of the adapter block 50 on the base 10. As shown in FIGS. 4-7, the alignment protrusion 62 allows the adapter block 50 to be self-fixturing on the base 10 because the alignment protrusion 62 must engage the first and second planar intersections 22 and 24 of the base 10 when the adapter block is placed onto the base 10. In the embodiment shown, the alignment protrusion 62 contacts the planar intersections 22 and 24 of the base 10. Alternatively, the alignment protrusion 62 may be engaged within, but not contact, the planar intersections 22 and 24 of the base 10. Controlling the forward and rearward positioning of the adapter block 50 on the base 10 may allow the front edge 14 of the base 10 to be protected by front nose portion 53 of the adapter block 50.

In accordance with an embodiment of the present invention, the front planar intersection 26 of the base 10 may engage the alignment tab 66 of the adapter block 50 to restrict movement of the adapter block 50 in relation to the base 10. As shown in FIGS. 4 and 6, the front planar intersection 26 of the base 10 contacts the alignment tab 66 of the adapter block 50 to help provide a desired orientation and alignment position between the adapter block 50 and the base 10 without the need for measurement. Specifically, contact between the alignment tab 66 and the front planar intersection 26 limits side to side movement of the adapter block 50 on the base 10. The alignment tab 66 engaged in the front planar intersection 26 may prevent misalignment between the side surfaces of the adapter block 50 and the base 10. The alignment tab 66 has an extension distance from the mounting surface 60 selected to engage the front planar intersection 26. For example, the extension distance of the alignment tab 66 may typically range from 0 to 0.25 inch, or from 0.05 to 0.2 inch, or from 0.075 to 0.15 inch. In certain embodiments, the front planar intersection 26 may be formed as a groove recessed in the holder receiving surface 12 having a depth, as shown in FIGS. 4, 7, 8 and 9. For example, the depth of the front planar intersection 26 may typically range from 0 to 0.2 inch, or from 0.05 to 0.15 inch, or from 0.075 to 0.12 inch. The extension distance of the alignment tab 66 is typically slightly larger than any depth of the front planar intersection 26 in order to provide a desired spacing between the mounting surface 60 and the holder receiving surface 12. For example, the alignment tab 66 may be from 0.01 to 0.2 inch larger than the depth of the front planar intersection 26, or from 0.02 to 0.1 inch larger, as shown in FIG. 6.

In accordance with an embodiment of the present invention, the alignment tab 66 has a width selected to the front planar intersection 26. For example, the width of the alignment tab 66 may typically range from 0 to 0.6 inch, or from 0.25 to 0.5 inch, or from 0.35 to 0.45 inch. As shown in FIGS. 4 and 7-9, the front planar intersection formed as a groove may have a width. For example, the width of the front planar intersection 26 may typically range from 0 to 0.6 inch, or from 0.25 to 0.5 inch, or from 0.35 to 0.45 inch. The width of the alignment tab 66 may be selected to allow a clearance fit between the alignment tab 66 and the front planar intersection 26. However, any other suitable type of fit between the alignment tab 66 and the front planar intersection 26 may be used, such as, a slip fit, a slide fit, a press fit, or the like. In accordance with another embodiment of the present invention, the alignment tab 66 may only make line or band contact with the holder receiving surface 12 at or near the front planar intersection 26.

A generally semicircular cross-section of the alignment protrusion 62 is shown in FIGS. 13, 15, 17 and 18. However, any other suitable shape or type of alignment protrusion 62 cross-sectional shape may be used, e.g., rectangular, square, triangular, serrated, complex curved, or the like. In the embodiment shown, there is a single centrally located alignment protrusion 62, but any other suitable number and location of alignment protrusion(s) may be used. In the embodiment shown, the alignment protrusion 62 extends from the first side 56 to the second side 57 of the mounting surface 60 with a consistent extension distance. However, the extension distance of the alignment protrusion may be varied from the first side to the second side of the mounting surface 60. In certain embodiments, the location of the alignment protrusion 62 is selected to allow the adapter block 50 to be properly aligned on the base 10 when the alignment protrusion 62 engages the first and second planar intersections 22 and 24 of the base 10.

As shown in FIGS. 4 and 7-10, the first and second planar intersections 22 and 24 comprise a generally semicircular cross-section groove recessed in the holder receiving surface 12. However, any other suitable cross-sectional shape of retaining groove may be used, e.g., rectangular, square, trapezoidal, hexagonal, ovular, triangular, or the like. As shown in FIGS. 8 and 9, a first side of the first planar intersection 22 transitions into the first rear planar face 34 and a second side of the first planar intersection 22 transitions into the first front planar face 40. As shown in FIGS. 8 and 9, a first side of the second planar intersection 24 transitions into the second rear planar face 36 and a second side of the second planar intersection 24 transitions into the second front planar face 42.

A generally rectangular cross-section of the alignment tab 66 is shown in FIGS. 13 and 15. However, any other suitable shape or type of alignment tab 66 cross-sectional shape may be used, e.g., rectangular, square, triangular, serrated, complex curved, or the like. In the embodiment shown, there is a single centrally located alignment tab 66, but any other suitable number and location of alignment tab(s) may be used. In certain embodiments, the alignment tab 66 protrudes from the first and second planar faces 90 and 92 of the mounting surface 60. In the embodiment shown, the alignment tab 66 extends from the mounting surface 60 at the intersection of the first and second front planar faces 90 and 92 with a consistent extension distance. However, the extension distance of the alignment tab may be varied. In certain embodiments, the location of the alignment tab 66 is selected to allow the adapter block 50 to be properly aligned on the base 10 when the alignment tab 66 engages the front planar intersections 26 of the base 10.

As shown in FIGS. 4, 7-9 and 11, the front planar intersection 26 comprises a generally rectangular cross-section groove recessed in the holder receiving surface 12. However, any other suitable cross-sectional shape of retaining groove may be used, e.g., semicircular, square, trapezoidal, hexagonal, ovular, triangular, or the like. As shown in FIGS. 8 and 9, a first side of the front planar intersection 26 transitions into the first front planar face 40 and a second side of the front planar intersection 26 transitions into the second front planar face 42.

In accordance with an embodiment of the present invention, the rear base engagement region 70, the first base engagement region 72 and the front base engagement region 74 of the mounting surface 60 of the adapter block 50 may be varied in size, shape and orientation depending on the size, shape and orientation of the faces of the holder receiving surface 12 of base 10. For example, the front base engagement region 74 may be formed as a single planar face, the rear base engagement region 70 may include an alignment tab, the mounting surface 60 may be formed without a first base engagement region 72, the mounting surface 60 may have a single planar face or the like.

In accordance with an embodiment of the present invention, the alignment protrusion 62 and the alignment tab 66 of the adapter block 50 contact a portion of the planar intersections 22, 24 and 26 of the base 10, the adapter block 50 is properly aligned and restricted from moving on the base 10. The alignment protrusion 62 and the alignment tab 66 of the adapter block 50 engaging the planar intersections 22, 24 and 26 of the base 10 provides a desired orientation between the adapter block 50 and the base 10 prior to bonding without measuring the alignment between the component. In accordance with an embodiment of the present invention, the desired orientation between the adapter block 50 and the base 10 provided by the alignment features allows the first and second sides 56 and 57 of the adapter block 50 to align with the first and second sides 18 and 19 of the base 10 without the need to make adjustments to the adapter block 50.

As shown in detail in FIGS. 12-15, 17 and 18, the adapter block 50 comprises the alignment protrusion 62 and the alignment tab 66 extending from the mounting surface 60. In accordance with an embodiment of the present invention, the alignment protrusion 62 has a generally semicircular cross-section to correspond to the semicircular cross-section of the first and second planar intersections 22 and 24 of the base 10. However, any other suitable shape and cross-sectional shape of alignment protrusion may be used, e.g., rectangular, square, trapezoidal, hexagonal, ovular, triangular, or the like. In accordance with an embodiment of the present invention, the alignment tab 66 has a generally rectangular cross-section to correspond to the semicircular cross-section of the front planar intersection 26 of the base 10. However, any other suitable shape and cross-sectional shape of alignment protrusion may be used, e.g., semicircular, square, trapezoidal, hexagonal, ovular, triangular, or the like.

As shown in FIGS. 14 and 15, the alignment tab 66 may extend from the mounting surface 60 adjacent to the front edge 61 of the mounting surface 60. Alternatively, the alignment tab 66 may be provided at an offset distance from the front edge 61 of the mounting surface 60. In the embodiment shown, the adapter block 50 comprises a single alignment tab 66 located between the first and second front planar faces 90 and 92, but any other suitable number of alignment tabs may be used, e.g., two, three, four or more. Additional alignment tabs 66 may be located on the mounting surface 60 of the adapter block 50 based on the location of additional planar intersections. In accordance with an embodiment of the present invention, and as previously discussed herein, the alignment tab 66 has an extension distance selected to allow the alignment tab to contact the bottom of the front planar intersection 26. The alignment tab 66 contacting the front planar intersection 26 provides a point of contact between the adapter block 50 and the base 10.

In accordance with an embodiment of the present invention, the alignment and mounting structural features of the base 10 and the adapter block 50 act to consistently achieve a properly aligned mounting assembly 5. As understood by those skilled in the art, if the correct positioning of the two components is not achieved prior to bonding, a weak bond may be formed and may lead to failure. The self-fixturing features of the adapter block 50 and the base 10 allow for a repeatable guide to achieving the proper positioning of the adapter block 50 on the base 10 without measurement or adjustment.

In accordance with an embodiment of the present invention, the planar intersections of the base 10, and the alignment protrusion 62, the alignment tab 66 and the rear of the adapter block 50 allow the mating of the base 10 and the adapter block 50 to be self-fixturing for optimal bonding. Further, as previously discussed herein, the structural features of the base 10 and the adapter block 50 provides correct positioning between the adapter block 50 and the base 10 to allow for proper cutting performance to be achieved by the mounting assembly 5. As understood by those skilled in the art, the self-fixturing features of the adapter block 50 and the base 10 allow the mounting assembly 5 to be formed without the need to measure or adjust the adapter block 50 on the base 10. In addition, the adapter block 50 may be secured to the base 10 without the use of mechanical fasteners. For example, as shown in FIG. 6, the mounting assembly 5 may be formed without using a clamping screw in the clamping bore 13.

The base 10 may be made of any suitable conventional material, such as steel, stainless steel, aluminum, titanium or any other material having sufficient strength. The base 10 of the present invention may be fabricated by any suitable technique, such as casting, investment casting, machining, hot forging, cold forging and/or additive manufacturing, to provide the planar intersections and planar faces. The adapter block 50 may be made of any suitable conventional material, such as steel, stainless steel, aluminum, titanium or any other material having sufficient strength. The adapter block 50 of the present invention may be fabricated by any suitable technique, such as molding, casting, machining, hot forging, cold forging and/or additive manufacturing, to provide the alignment protrusion, alignment tab, and planar faces.

Figure 19:
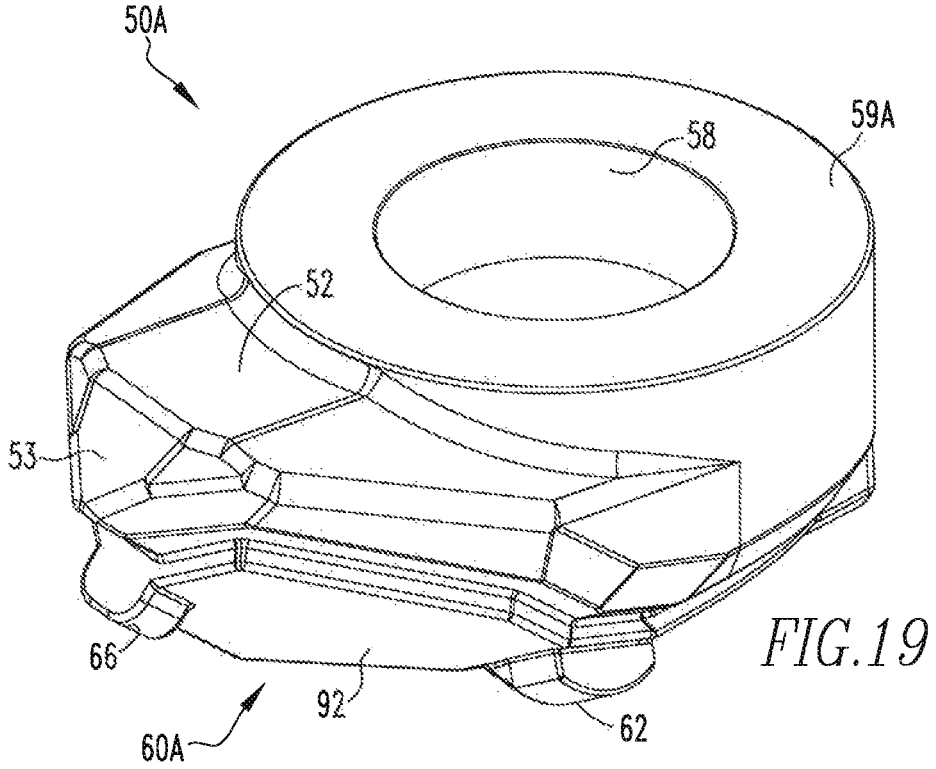
FIG. 19 is a top-front isometric view of an adapter block in accordance with another embodiment of the present invention.
Figure 20:
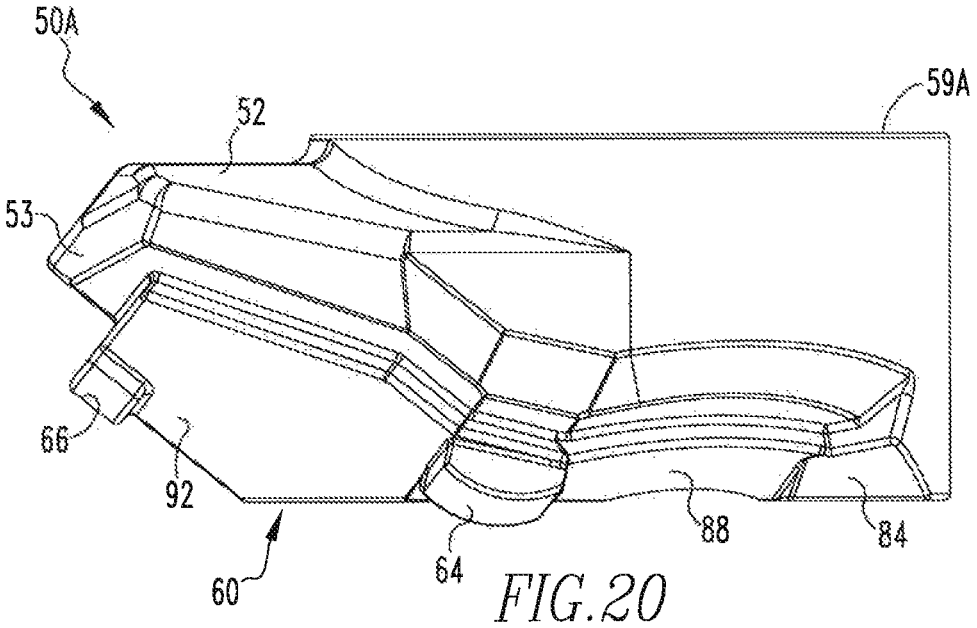
FIG. 20 is a side view of the adapter block of FIG. 19.

FIGS. 19 and 20 illustrates an adapter block 50A in accordance with another embodiment of the present invention. Similar element numbers are used in FIGS. 19 and 20 for common features that are present in the embodiment of FIGS. 1-7 and 12-18. As shown in FIG. 20, the shoulder 59A of the adapter block 50A may extend a shorter distance from the top surface 52 of the adapter block than the embodiment shown in FIGS. 1-7 and 12-18. The extension length of the shoulder 59A may be varied depending on the cutting tool that will be inserted into the bore 58. For example, the smaller shoulder 59A and bore 58 shown in FIGS. 19 and 20 may be structured and arranged to receive a wear sleeve (not shown) and a cutting tool (not shown) comprising carbide, steel, diamond or the like.

Figure 21:
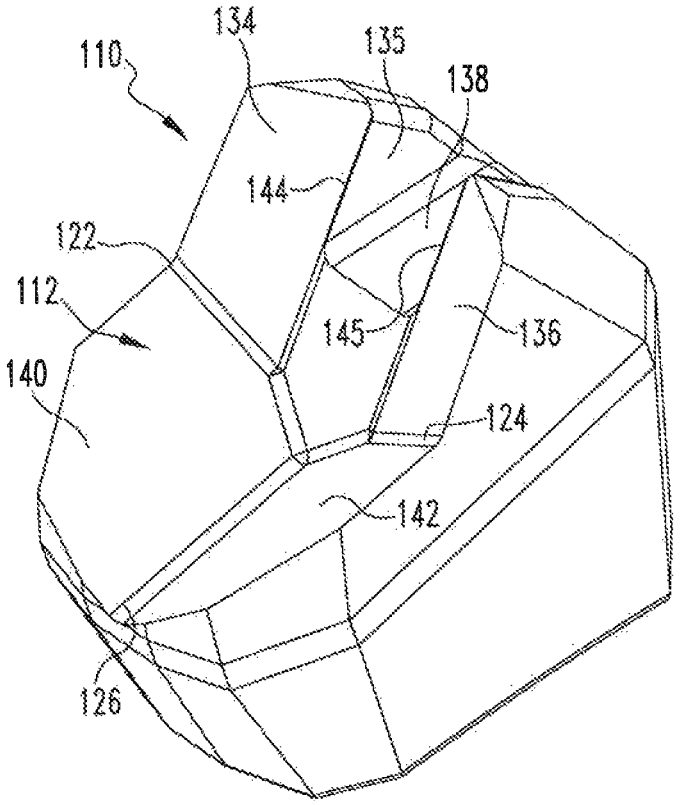
FIG. 21 is an isometric view of a base block in accordance with another embodiment of the present invention.
Figure 22:
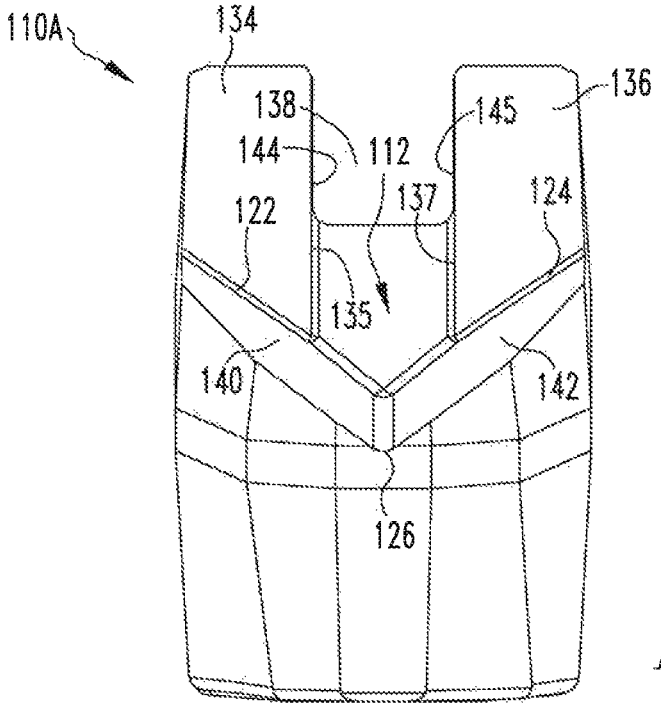
FIG. 22 is a front view of the base block of FIG. 21.
Figure 23:
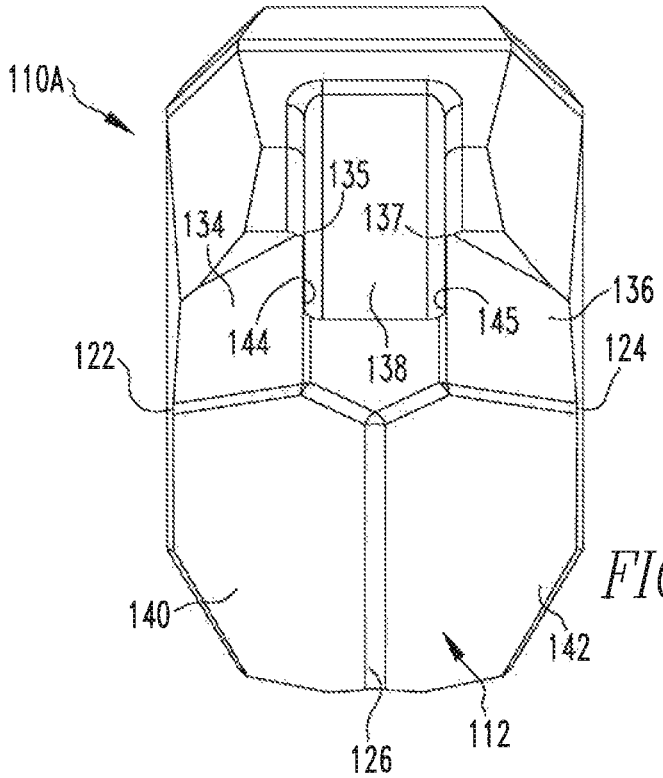
FIG. 23 is a front view of the base block of FIG. 21.

FIGS. 21-23 illustrate a base 110 in accordance with another embodiment of the present invention. Similar element numbers are used in FIGS. 21-23 for common features that are present in the embodiment of FIGS. 1-11. In accordance with an embodiment of the present invention, the first and second planar intersections 122 and 124 and the front planar intersection 126 may be formed by the intersection of two or more planar surfaces. In the embodiment shown, the first and second planar intersections 122 and 124 may be formed as a blend between the first and second rear planar faces 134 and 136 and the first and second front planar faces 140 and 142 and the front planar intersection 126 may be formed as a blend between the first and second front planar faces 140 and 142. In accordance with an embodiment of the present invention, the first rear planar face 134 may intersect directly with the first front planar face 140 to form the first planar intersection 122 and the second rear planar face 136 may intersect directly with the second front planar face 142 to form the first planar intersection 124. In certain embodiments, the first front planar face 140 may intersect directly with the second front planar face 142 to form the front planar intersection 126. In the embodiment shown in FIGS. 21-23, the holder receiving surface 112 is formed without a clearance opening between the planar faces of the base 10. Alternatively, the holder receiving surface 112 may be formed with a clearance opening.

In accordance with an embodiment of the present invention, an adapter block identical to or substantially similar to the adapter blocks 50 and 50A of FIGS. 1-7 and 12-20 may be mounted on the base 110. In certain embodiments, the alignment protrusion 62 may contact the holder receiving surface 112 at or near the first and second planar intersections 122 and 124. In certain embodiments, the alignment tab 66 may contact the holder receiving surface 112 at or near the front planar intersection 126. In the embodiment shown in FIGS. 21-23, a portion of the alignment protrusion 62 may make line or band contact with the first and second planar intersection 122 and 124 and a portion of the alignment tab 66 may make line or band contact with the front planar intersection 126.

In accordance with an embodiment of the present invention, the contact between the alignment protrusion 62 and the alignment tab 66 may create an offset between the planar faces of the mounting surface 60 of the base 50 and the planar faces of the holder receiving surface 112 of the base. For example, the first planar face 86 of the first base engagement region 72 may be offset from the first rear planar face 134 of the base 110 and the second planar face 88 of the first base engagement region 72 may be offset from the second rear planar face 136 of the base 110, the first front planar face 90 may be offset from the first front planar face 140 of the base 10 and the second front planar face 92 may be offset from the second front planar face 142 of the base 10. In accordance with an embodiment of the present invention, the offset spacing between the adapter block 50 and the base 110 may be closed when the adapter block 50 is bonded to the base 110. For example, the spacing between the planar faces of the adapter block 50 and the base 110 may be closed by welding, filled with braze material, adhesives or the like.

In accordance with an embodiment of the present invention, the points of contact between the alignment protrusion 62 and the alignment tab 66 of the adapter block 50 and the planar intersections 122, 124 and 126 of the base 110 may be the only points of contact between the mounting surface 60 of the adapter block 50 and the holder receiving surface 112 of the base 110 prior to bonding. In accordance with an embodiment of the present invention, the rear base engagement region 70 of the adapter block 50 may also be structured and arranged to contact the base 110. In certain embodiments, the rear base engagement region 70 may be sized to correspond to the opening 138 of the base 110. In accordance with an embodiment of the present invention, the first angled portion 82 of the rear base engagement portion 70 may mate or engage with the first opposing face 135 and/or the first intersection 144 of the base 110 and the second angled portion 84 of the rear base engagement portion 70 may mate or engage with the second opposing face 137 and/or the second intersection 145 of the base 110.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

For purposes of the description above, it is to be understood that the invention may assume various alternative variations and step sequences except where expressly specified to the contrary. Moreover, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A mounting assembly for a cutting tool comprising:

a base comprising a holder receiving surface including at least one planar intersection and a front planar intersection; and an adapter block, the adapter block comprising:

an adapter block body having a top surface and a mounting surface;

at least one alignment protrusion tab extending from the mounting surface structured and arranged to engage the at least one planar intersection of the base; and at least one alignment tab extending from the mounting surface structured and arranged to engage the front planar intersection of the base, wherein the front planar intersection is a mounting groove recessed in the holder receiving surface and extends from a front edge of the holder receiving surface to a clearance opening.

2. The mounting assembly for a cutting tool of claim 1 further comprising a first planar intersection extending from a first side edge of the holder receiving surface to the clearance opening, a second planar intersection extending from the clearance opening to a second side edge of the holder receiving surface.

3. The mounting assembly for a cutting tool of claim 1, wherein the holder receiving surface comprises a first mounting region extending from a rear edge of the holder receiving surface of the planar intersection, and a second mounting region extending from the planar intersection to a front edge of the holder receiving surface.

4. The mounting assembly for a cutting tool of claim 3, wherein the first mounting region comprises a first rear planar face and a second rear planar face, and the second mounting region comprises a first front planar face and a second front planar face.

5. The mounting assembly for a cutting tool of claim 4, wherein the front planar intersection is between the first front planar face and the second front planar face of the second mounting region.

6. The mounting assembly for a cutting tool of claim 1, wherein the mounting surface comprises a rear base engagement region extending from a rear edge of the mounting surface to a first base engagement region, the first base engagement region extending from the rear base engagement region to the at least one alignment protrusion; and a front base engagement region extending from the at least one alignment protrusion to a front edge of the mounting surface.

7. The mounting assembly for a cutting tool of claim 6, wherein the first base engagement region comprises a first planar face and a second planar face, and the front base engagement region comprises a first front planar face and a second front planar face.

8. The mounting assembly for a cutting tool of claim 7, wherein the first planar face of the first base engagement region of the adapter block is structured and arranged to correspond to the first rear planar face of the first mounting region of the base, the second planar face of the first base engagement region of the adapter block is structured and arranged to correspond to the second rear planar face of the first mounting region of the base, the first front planar face of the front base engagement region of the adapter block is structured and arranged to correspond to the first front planar face of the second mounting region of the base, and the second front planar face of the front base engagement region of the adapter block is structured and arranged to correspond to the second front planar face of the second mounting region of the base.

9. The mounting assembly for a cutting tool of claim 7, wherein the first planar face of the first base engagement region of the adapter block is offset from the first rear planar face of the first mounting region of the base, the second planar face of the first base engagement region of the adapter block is offset from the second rear planar face of the first mounting region of the base, the first front planar face of the front base engagement region of the adapter block is offset from the first front planar face of the second mounting region of the base, and the second front planar face of the front base engagement region of the adapter block is offset from the second front planar face of the second mounting region of the base.

10. The mounting assembly for a cutting tool of claim 1, wherein the at least one alignment protrusion of the adapter block extends from a first side to a second side of the mounting surface of the adapter block.

11. The mounting assembly for a cutting tool of claim 1, wherein the at least one alignment tab is centrally located between a first front planar face and a second front planar face of a front base engagement region.

12. The mounting assembly for a cutting tool of claim 1, wherein the adapter block comprises a cutting tool receiving opening extending from the top surface to the mounting surface.

13. The mounting assembly for a cutting tool of claim 1, wherein a bottom surface of at least one the alignment protrusion contacts the planar intersection of the base and a bottom surface of the at least one alignment tab contacts the front planar intersection of the base.

14. The mounting assembly for a cutting tool of claim 1 wherein the at least one alignment protrusion has an extension distance less than a distance between the top surface and a planar face of the mounting surface.

15. The mounting assembly for a cutting tool of claim 2, wherein the first planar intersection and the second planar intersection are mounting grooves recessed in the holder receiving surface; and wherein the at least one alignment protrusion of the mounting adapter block is structured and arranged to be received within the first and second planar intersections.

16. An adapter block for a mounting assembly for a cutting tool comprising: an adapter block body having a top surface and a mounting surface opposite the top surface;

at least one alignment protrusion extending from the mounting surface structured and arranged to engage a first planar intersection of a base block; and at least one alignment tab extending from the mounting surface structured and arranged to engage a front planar intersection of the base block, wherein the mounting surface comprises a front base engagement region extending from a front edge of the mounting surface to the at least one alignment protrusion and a first base engagement region extending from the at least one alignment protrusion.

17. The adapter block of claim 16, wherein the at least one alignment protrusion has an extension distance less than a distance between the top surface and a planar face of the mounting surface.

18. The adapter block of claim 16, wherein the at least one alignment tab is centrally located between a first front planar face and a second front planar face of a front base engagement region of the mounting surface of the adapter block.

19. The adapter block of claim 16, wherein the adapter block comprises a cutting tool receiving opening extending from the top surface to the mounting surface.

20. A mounting assembly for a cutting tool comprising:

a base comprising a holder receiving surface including a front planar intersection; and an adapter block, the adapter block comprising:

an adapter block body having a top surface and a mounting surface;

at least one alignment tab extending from the mounting surface structured and arranged to engage the front planar intersection of the base, wherein the front planar intersection is a mounting groove recessed in the holder receiving surface and extends from a front edge of the holder receiving surface to a clearance opening.

21. The mounting assembly for a cutting tool of claim 20, wherein the at least one alignment tab is centrally located between a first front planar face and a second front planar face of a front base engagement region.

22. The mounting assembly for a cutting tool of claim 20, wherein the adapter block further comprises at least one alignment protrusion extending from the mounting surface structured and arranged to engage at least one planar intersection of the base.

23. The mounting assembly for a cutting tool of claim 22, wherein a bottom surface of the at least one alignment protrusion contacts the planar intersection of the base arid a bottom surface of the at least one alignment tab contacts the front planar intersection of the base.

* * * * *